United States Patent [19]

Muller et al.

[11] Patent Number: 4,715,324

[45] Date of Patent: Dec. 29, 1987

[54] NUCLEAR STEAM GENERATOR SLUDGE LANCING METHOD AND APPARATUS

[75] Inventors: Gary R. Muller; Scott M. Theiss; James E. Brown, Jr., all of Palm Harbor; Bobby R. Lawson, Tarpon Springs, all of Fla.

[73] Assignee: Apex Technologies, Inc., Stuart, Fla.

[21] Appl. No.: 801,730

[22] Filed: Nov. 26, 1985

[51] Int. Cl.[4] ..... F22B 37/52; F22B 37/54

[52] U.S. Cl. ..... 122/381; 122/382; 122/392; 15/316 R; 134/172; 376/310; 376/316

[58] Field of Search ..... 122/390, 391, 392, 381, 122/382; 134/170, 172; 376/310, 312, 316; 15/316 R

[56] References Cited

U.S. PATENT DOCUMENTS

| | | | |
|---|---|---|---|
| 4,079,701 | 3/1978 | Hickman et al. | 122/405 X |
| 4,135,534 | 1/1979 | Autelli | 165/5 X |
| 4,445,465 | 5/1984 | Byrd et al. | 122/392 |

FOREIGN PATENT DOCUMENTS

| | | |
|---|---|---|
| 85108357.6 | 1/1986 | European Pat. Off. . |
| 315446 | 7/1929 | United Kingdom . |

*Primary Examiner*—John F. Terapane

*Assistant Examiner*—John S. Maples

*Attorney, Agent, or Firm*—Sughrue, Mion, Zinn, Macpeak & Seas

[57] ABSTRACT

A method and apparatus for removing from the tube sheet and transfer tubes of a nuclear steam generator sludge deposits which occur from the use of all volatile treatment water chemistry. A continuously activated suction apparatus maintains at a low level the water/-sludge inventory on the tube sheet. A high pressure first water lance is oscillated and stepped inwardly along the central tube lane of the generator to dislodge the sludge from the tube plate and heat exchange tubes. After this lance has been stepped inwardly to a predetermined position, a low pressure second water lance is activated and periodically advanced to a position just short of the first lance and functions both to dislodge sludge and to form a water barrier which prevents redeposition of sludge in the clean area. The flows from both lances combine to produce a high flow of water-suspended sludge which flows across the top of the tube sheet to the annulus of the steam generator where it is removed by the suction apparatus without any redeposition. Suction dams are placed in the vicinity of the suction apparatus in order to increase the efficiency of the removal of the water-entrained sludge by suction.

16 Claims, 7 Drawing Figures

NUCLEAR STEAM GENERATOR SLUDGE LANCING METHOD AND APPARATUS

BACKGROUND OF THE INVENTION

1. Field of the Invention

This invention relates generally to the cleaning of steam generators and, more particularly, to an improved method and apparatus for removing sludge from the tube sheet of a nuclear steam generator.

2. Description of the Prior Art

Nuclear power plants typically utilize steam generators having a vertical inverted U-shaped tube bundle which carries the primary water directly heated by the nuclear reaction. Feedwater is carried by the shell side of the exchanger in contact with the tube bundle for generating steam to be directed to steam turbines.

Among the maintenance problems that can arise in such nuclear power plants, some of the most potentially troublesome include sludge build-up in the steam generator, and particularly relate to concentrations of sludge which may accumulate on the tube sheet at the lower end of the tube bundle.

This accumulation of sludge lowers steam production capacity, and the particles in the feedwater can cause abrasion of the U-tubes in the upper portions of the steam generator. These solids may even cause the steam turbine to foul if they are carried over in the steam. Also, since water chemistry cannot be controlled within the sludge piles, the steam generator tubes may corrode or dent.

Several problems are caused by damaged tubes. Primary water from the tube bundle may leak into the feedwater that is to be turned into steam, thus creating a safety hazard. Plugged and sleeved tubes reduce the heat transfer area of the steam generator. As more time is required to be allotted to maintenance, more radiation exposure is required for maintenance personnel. Also, the steam generator's productive life span can be decreased significantly.

There are several U.S. patents disclosing various methods and apparatuses for the sludge lancing of steam generators:

U.S. Pat. Nos. 4,079,701 and 4,276,856 disclose a high pressure, low flow single movable lance system and method that require a fluid flushing stream continuously maintained from a pair of stationary flushing fluid injection nozzles inserted in one hand hole of the steam generator, around the annular space between the lower shell of the steam generator and the tube bundle, to a flushing fluid suction apparatus located diametrically opposite the first hand hole at a second hand hole. While the fluid flushing stream is continuously maintained, the single movable fluid lance is placed in the steam generator through the first hand hole and moved along the tube lane to dislodge sludge deposits from between the tube rows and move the sludge outward into the annular space where the sludge is entrained in the continuously flowing flushing fluid stream. This lancing system and method were developed when nuclear power plants were using phosphate water chemistry which produced a type of sludge which is different from the all-volatile-treatment (AVT) water chemistry used in nuclear power plants today. The former phosphate water chemistry produced sludge components, mainly metallic oxide, which were cemented together by the phosphate salts into large, tightly adherent deposits on the tube sheet. The primary purpose of the high pressure, low flow single lance was to loosen, dislodge and to transport these large particles to a high volume, annularly flowing flushing stream. Such a prior art system and method is not efficient for use in today's nuclear power plants using AVT chemistry which produces a sludge which is fine and loosely adherent.

U.S. Pat. Nos. 4,445,465 and 4,498,427 disclose improved sludge lancing systems which alternately direct the entire fluid flow first to the single movable lance for dislodging the sludge from between the tube rows and moving it outward to the periphery of the tube bundle, and then to a stationary flushing fluid injector which directs the entirety of the available fluid around the periphery of the tube bundle to flush the sludge which was dislodged in the previous lancing cycle.

U.S. Pat. No. 4,424,769 discloses a sludge lancing system in which two streams of cleaning fluid under a high pressure are directed from the end portion of a lance toward the tubular plate between two parallel sheets of tubes and in directions which are fixed and symmetrical with respect to the direction of the two sheets of tubes. A mechanism is provided for cutting off the streams of high pressure water as the water jets confront the tubes during radial movement of the lance.

U.S. Pat. No. 4,452,183 discloses a sludge lancing system in which two high pressure water jets are operated simultaneously from opposite hand holes to insure that the sludge is moved to the periphery without redeposition of the sludge in areas of the steam generator. Furthermore, there is required simultaneous evacuation throughout the length of the zone in order to remove the sludge.

U.S. Pat. No. 4,527,515 discloses a control system for a single movable lance sludge removal system, wherein a valve is provided for directing a pressurized fluid to either a jetting outlet or a flushing outlet.

U.S. Pat. No. 4,273,076 and 4,492,186 disclose additional single movable lance sludge removal systems.

In addition, British Pat. 315,446 discloses a method and apparatus for removing sand from a casting, wherein two nozzles are mounted one above the other, with one nozzle emitting a very high pressure cutting stream, and the other nozzle emitting a lower pressure rinsing stream.

SUMMARY OF THE INVENTION

The general object of this invention is to provide a steam generator sludge lancing method and apparatus which is particularly efficient in removing sludge deposits from the tube sheet and tubes of a nuclear steam generator employing AVT water chemistry.

A more specific object of this invention is to provide such a method and apparatus incorporating two movable lances each incorporating a plurality of nozzles, and each contributing to the sludge-lancing operation and to the maintaining of the fine sludge particles in suspension, thereby facilitating the removal of fluid-entrained sludge to a suction apparatus and eliminating the need for a separate injection header for maintaining a continuously flowing flushing stream around the peripheral lane of the tube sheet of the generator.

Still another object of the invention is to provide fluid dams on the tube sheet near the suction apparatus for increasing the volume of sludge-laden water at the suction apparatus, thereby increasing the efficiency of the sludge removal operation.

DETAILED DESCRIPTION OF THE PREFERRED EMBODIMENT

Figure 1:
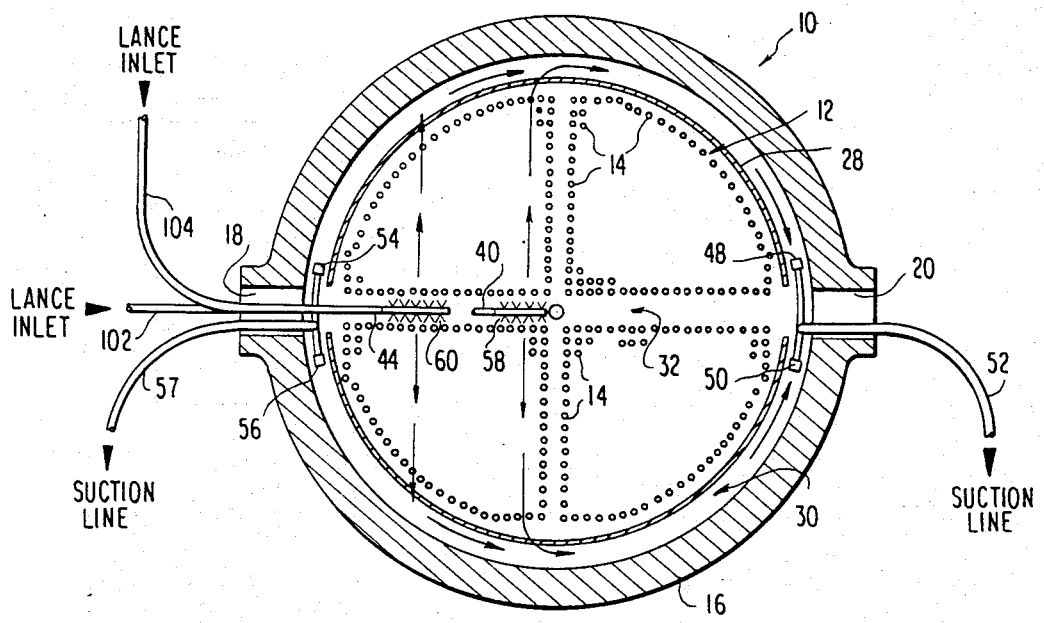
FIG. 1 is a top plan view of a steam generator schematically showing a preferred embodiment of the improved sludge lancing method and apparatus of this invention.
Figure 2:
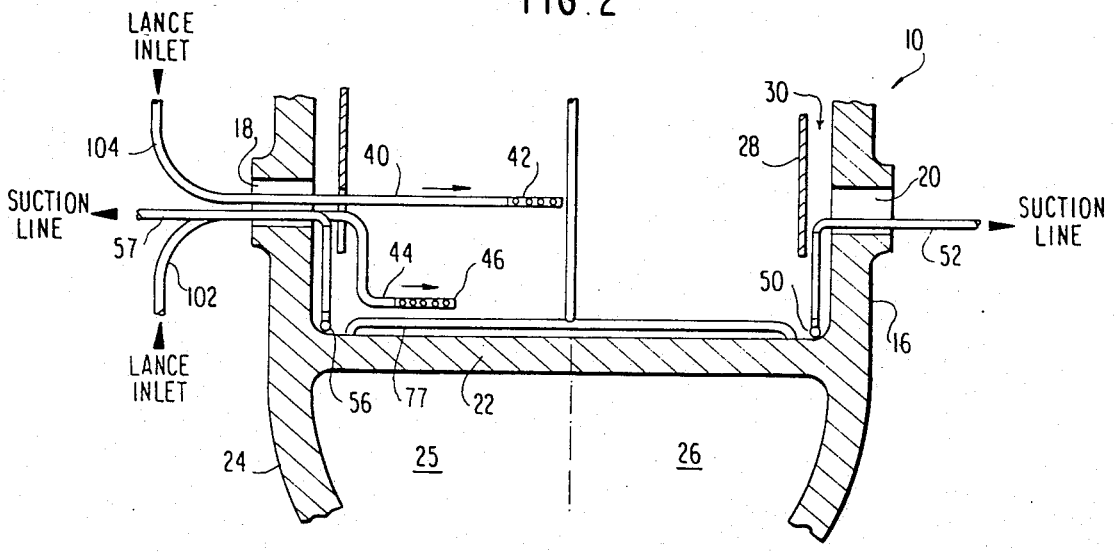
FIG. 2 is a front elevational view of FIG. 1.

Schematically shown in FIG. 1 in horizontal cross-section and in FIG. 2 in vertical cross-section is a steam generator 10 of a nuclear reactor of a type which, itself, is well known in the prior art such as that described, for example, in U.S. Pat. Nos. 4,079,701; 4,445,465; and 4,498,427.

The steam generator includes an inverted U-shaped tube bundle shown generally in cross-section and designated by the numeral 12 in FIG. 1. Tube bundle 12 includes a plurality of hollow heat exchange tubes, designated by the numeral 14, which are arranged in a plurality of parallel, equally spaced horizontal rows as viewed in FIG. 1.

Steam generator 10 includes an outer shell 16 having a pair of diametrically opposite hand holes 18 and 20. A tube sheet 22 is attached to the lower portion of outer shell 16 in order to isolate the portion of the steam generator above the tube sheet 22 from the lower portion 24 in a fluid tight manner. The open ends of the heat exchange tubes 14 extend through holes in tube sheet 22 so that one end of each tube is in fluid communication with the reactor coolant inlet compartment 25 and the other end with the reactor coolant outlet compartment 26.

Tube bundle 12 is encircled by a wrapper 28 which together with outer shell 16 forms an annular chamber 30.

Because of the U-shape of the tubes 14, there is formed along the tube sheet 22 a straight line section which is free of tubes and is referred to as a central tube lane or blow down lane 32 which is co-linear with the diameter passing through the oppositely disposed hand holes 18 and 20.

In the operation of the steam generator, feedwater passes in heat transfer relationship with the outside of the U-tubes 14 which carry the water which has been heated by circulation through a nuclear reactor core. With the use of AVT water chemistry, during operation of the steam generator sludge may form on the tube sheet 22 around tubes 14 of the tube bundle 12. The deposited sludge is fine and loosely adherent to the tubes and tube sheet. However, this sludge can product tube defects which allow radioactive particles in the reactor coolant flowing in tubes 14 to leak out into the feedwater and into the steam produced by the steam generator. (All-volatile treatment refers to the type of chemicals that are added to steam generators to remove trace amounts of oxygen and to adjust pH both in the steam generators and also throughout the steam cycle. These chemicals, frequently hydrazine and ammonia, do not concentrate to any significant degree in the steam generator and are largely carried off with the steam. AVT is a term which is commonly accepted throughout the nuclear power industry and to a large extent wherever steam is generated.)

The present invention efficiently lances or dislodges this sludge from the tubes and tube sheet by the use of two movable lances which advance inwardly along the tube lane, one behind the other, toward the center of the steam generator. The forward lance emits high pressure high volume jets of water, and the following lance emits lower pressure, high volume jets of water. The jets from both lances both dislodge and flush the sludge to form a volume of water in which the fine sludge particles are kept suspended and which is directed outwardly to the periphery of the tube sheet 22 from where it flows to the suction apparatus located on the tube sheet adjacent both hand holes. The suction apparatus at each hand hole comprises two suction tubes and a nozzle or water dam which functions to increase the efficiency of the removal of the water-suspended sludge. The operation is repeated by inserting two movable lances in the diametrically opposite hand hole. However, it is also contemplated that two pairs of movable lances may be inserted simultaneously in the opposite hand holes 18 and 20, respectively.

More specifically, as schematically illustrated in FIGS. 1 and 2, a first lance 40 is inserted through the left hand hole 18 into the tube lane 32; lance 40 carries on its inner end a plurality of high pressure jet nozzles 42 arranged in two rows circumferentially spaced apart by approximately 90 degrees; that is, the two rows are not diametrically opposed. Then, a second movable lance 44 is inserted below and behind the first lance 40. The second lance 44 carries on its inner end a plurality of high volume jet nozzles 46. Located diametrically opposite hand hole 18 and on the surface of tube sheet 22 are a pair of suction nozzles 48 and 50 which are connected to a suction line 52. Similarly located opposite the right hand hole 20 are a pair of suction nozzles 54 and 56 connected to a suction line 57. As will be explained below, a sludge collection nozzle or water dam is also inserted in each hand hole and positioned on the tube sheet 22 in order to improve the efficiency of removing the slurry or water-entrained sludge from the steam generator.

The first step of the lancing operation is to establish and maintain at a minimum the sludge/water slurry inventory in the steam generator. This operation is accomplished by activating the suction on each of the four suction nozzles 48, 50, 54 and 56. Then, the first movable lance 40 is positioned within the steam generator near hand hole 18. This high pressure lance 40 is then activated to produce non-diametrically opposed high pressure jets of water, while the lance is automatically rotated about its longitudinal axis to produce a hydraulic sweeping action from the blow down lane, through the tube bundle 12 and toward the outer shell 16. After several such sweeping operations, the high pressure movable lance 40 is automatically stepped inwardly along tube lane 32 of the tube bundle 12. These sweeping and inwardly stepping operations are continued until the outermost nozzle 58 on the high pressure lance 40 is located at a position just past the innermost nozzle 60 on the second lance 44. Once the first lance 40 reaches this position, the second lance 44 is activated to produce high volume multiple jets of water which contribute to the sludge lancing, and also produce a water barrier which precludes redeposition of dislodged sludge into previously cleaned area as will be described below in more detail with reference to FIG. 7. Both lances 40 and 44 and also the suction nozzles 48, 50, 54 and 56 now remain activated during the entire lancing operation.

Thus, the high pressure first lance 40 continues to step toward the center of the tube bundle 12, while the low pressure second lance 44 is continuously activated. After the first lance 40 has moved past a pre-selected number of tubes 14 along the tube lane 32, the second lance 44 is manually advanced inwardly again to a point where the nozzle 58 is just beyond the nozzle 60, thereby continually maintaining a flow barrier to preclude deposition of sludge in the clean area of the tube sheet. Lance 40 continues to advance until it is fully extended and positioned at the center of the tube bundle 12, and the second lance 44 follows as just described. At this time and assuming that a second pair of high pressure and low pressure lances are available and have been inserted in the opposite hand hole 20, the low pressure lance at the hand hole 20 is activated to flush from the tube bundle and tube sheet any sludge which may have randomly deposited. When this flushing operation is completed, the low pressure lance in the opposite hand hole 20 is deactivated, and the second high pressure lance is activated, whereby the same stepping and advancing operation of the two lances continues as just described. Each of these operational sequences of first moving the high pressure lance and then the low pressure lance from the periphery of the fuel bundle 12 to the center thereof is considered one pass. The complete lancing process consists of multiple passes through the tube bundle. During the entire lancing operation, a suction system coupled to the four suction nozzles maintains a minimum sludge/water level on the tube sheet 22.

During the sludge removal process, the high pressure multiple nozzle first lance 40 functions primarily to dislodge sludge from the tube lanes. While the low pressure second lance 44 also contributes to the sludge-dislodging function, it produces a high volume water barrier which shields against redeposition of this dislodged sludge onto the tube sheet. The hydraulic flow paths from both lances are directed from the bundle center line, through multiple paths of the bundle, to the bundle periphery where the combined flow from both lances impacts the inner wall of the steam generator shell 16 with sufficient force and volume of causes directional changes. The suction nozzles, which are continuously operated during the lancing process, are used to remove the excess water/sludge inventory which may occur as a result of the process. By maintaining the high volume flow from the second lance 44, once an area has been cleaned, it will remain clean. The multiple headed arrows on the tube sheet shown in FIG. 1 indicate approximate magnitudes and directions of the water-suspended sludge as it flows across the tube sheet to the peripheral lane 30 where it is removed from the steam generator via the suction nozzles 48, 50, 54 and 56.

Figure 3:
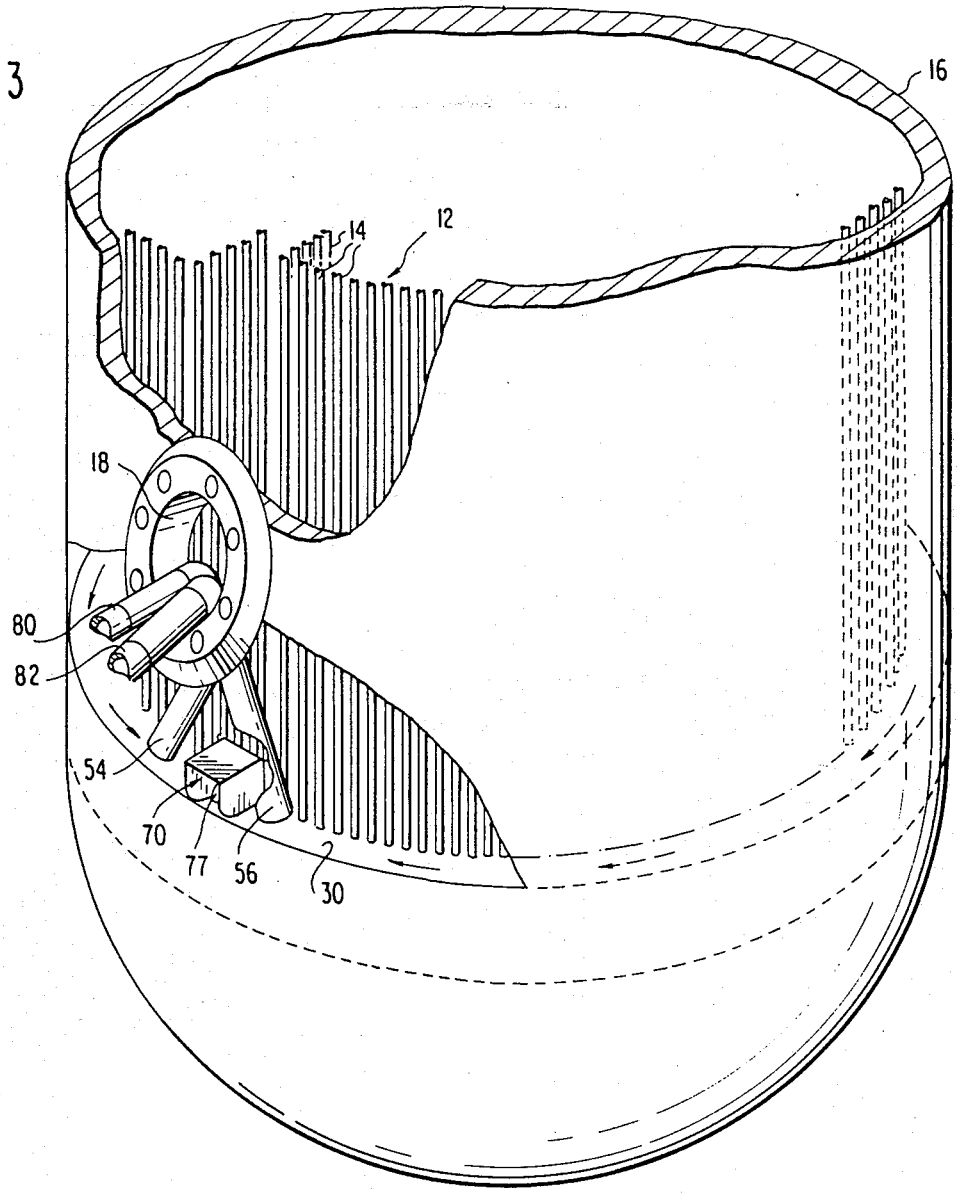
FIG. 3 is a partially cutaway perspective view of a steam generator and shows the manner and location in which a water or suction dam is mounted relative to the suction apparatus which removes the sludge-laden water from the tube sheet.
Figure 4:
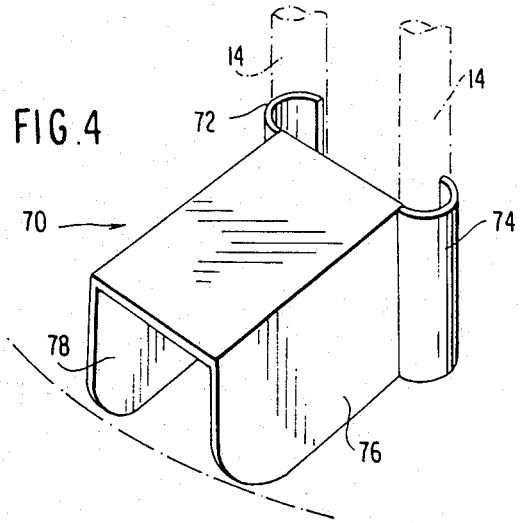
FIG. 4 is a perspective view showing in detail one of the suction dams.

FIG. 3 illustrates the manner in which a nozzle or water dam 70 is inserted between the diverging ends of suction nozzles 54 and 56, for example. The nozzle dam 70 is shown in detail in FIG. 4. The two curved inner flanges 72 and 74 clamp onto corresponding ones of the heat transfer tubes 14. It can be seen that the vertically extending flanges 76 and 78 form respective dams behind suction nozzles 56 and 58, thereby reducing the velocity of the fluid-entrained sludge and increasing the efficiency of the removal by suction of the water-entrained sludge primarily flowing in the peripheral tube lane 30. The flanges are preferably spaced apart to fit over a blow down pipe 77 which is normally located in the tube lane 32. Whereas FIGS. 1 and 2 show the suction nozzles in schematic form, FIG. 3 illustrated these nozzles and suction lines as they actually appear in real life. More specifically, the nozzles 54 and 56 are coupled to suction tubes 80 and 82 respectively, which are coupled externally of the steam generator to a common suction line as schematically illustrated in FIGS. 1 and 2 by the suction line 57.

Figure 5:
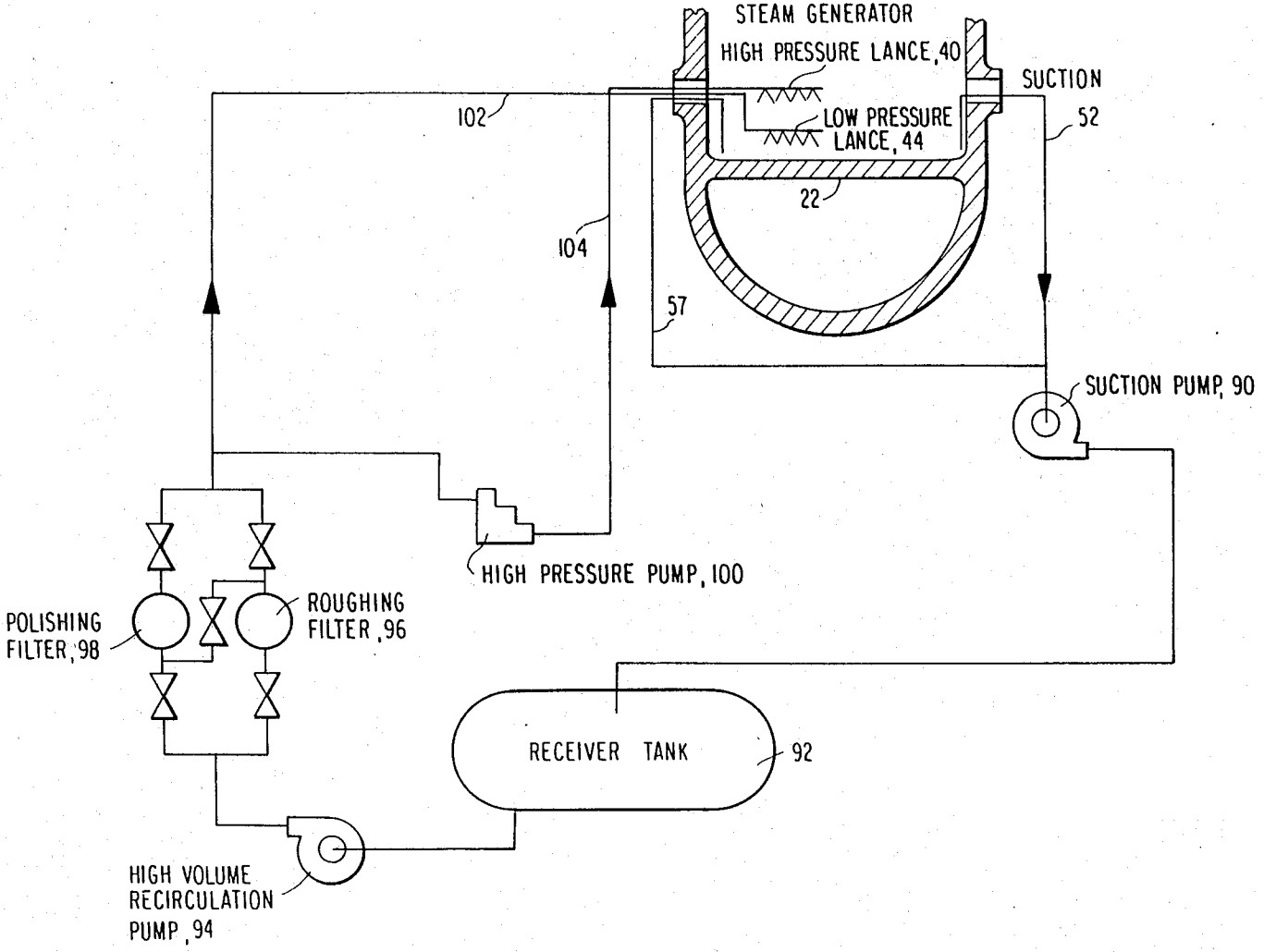
FIG. 5 is a schematic flow diagram of a sludge lancing system embodying the invention.

FIG. 5 schematically illustrates the fluid control system for the lances and suction lines. Sludge-laden water is pulled from the generator through suction tubes 48, 50, 54, and 56 placed just above the tube sheet 22, then through lines 52 and 57 by a large volume air-operated diaphragm suction pump 90. This slurry of sludge and water is discharged to a receiver tank 92. The outlet of this tank is connected by piping to a Low Pressure High Volume (LPHV) pump 94, which discharges (140 psi) to a roughing filter 96 which removes large pieces of sludge, then to a polishing filter 98 which removes particles of much smaller size. After filtration the water flow splits, one leg going to the suction side of a High Pressure High Volume (HPHV) pump 100 and the other leg going to the inlet line 102 of low pressure lance 44. The HPHV pump 100 boosts the 140 psi system pressure to 1500 psi and delivers this water via the inlet line 104 to the high pressure lance 40.

The high pressure lance inlet line is fed by the HPHV 1500 psi pump 100, and the nozzles 42 at the inner end of the lance 40 direct the flow down several tube lanes on each side of the generator. Automatic tube-by-tube step advancement and rocking the lance 40 through a 45° angle back and forth motion insure 100% coverage of the tube sheet 22. Behind the high pressure lance 40 is the low pressure lance 44 which also has several larger nozzles aligned with the tube rows. This lower pressure lance 44 both sets up a water barrier (see FIG. 7) and also dislodges sludge and constantly flushes the tube sheet 22 behind the high pressure lance 40 to keep the sludge moving to the suction pickup tubes 48 and 50 on the diametrically opposite side of the generator and away from the cleaned area.

Figure 6:
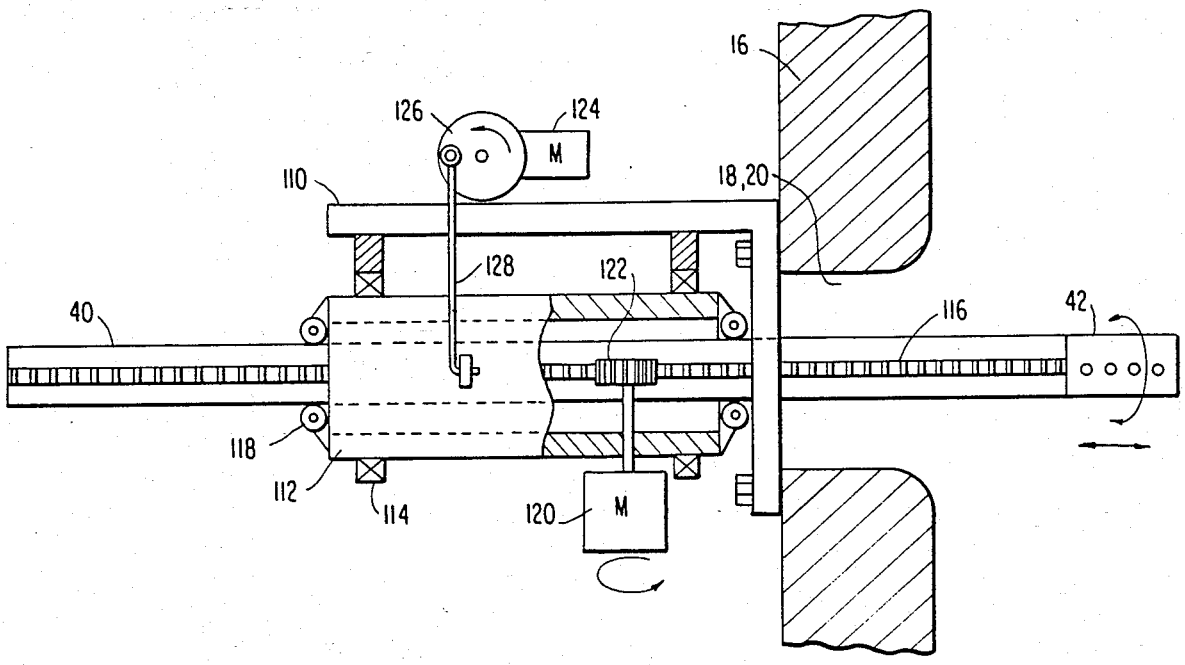
FIG. 6 is a schematic diagram of a mechanism for stepping the high pressure lance in the preferred embodiment of the invention.

FIG. 6 schematically illustrates a preferred embodiment of a mechanism for advancing and racking the high pressure lance 40. The mechanism consists of a frame 110 which bolts to the hand hole 18 or 20 in the steam generator shell 16. The frame supports a barrel 112 mounted in large diameter bearings 114 which allow the barrel to rotate about the hand hole centerline. The lance 40 and integral rack 116 pass through this barrel and are supported by smaller bearings 118 which are mounted to the barrel and which allow the lance 40 to progress into, or retract from, the interior of the steam generator.

A stepper indexing motor 120 is mounted on the barrel 112 and by an external control causes a pinion 122 to turn a specific predetermined amount, thereby moving the rack 116 and also the lance 40 the desired distance.

A constant-speed AC motor 124 mounted on the frame 110 slowly turns an eccentric 126 which is connected via a link 128 to the barrel 112, thereby causing the barrel to rock back and forth and allowing the water nozzles 42 to sweep across the tube sheet.

In general, the high pressure lance 40 is segmented and preferably contains two rows of four nozzles each. The total flow from the nozzles is at the rate of 30–50 gpm, with 40 gpm being preferred, under a pressure of 1000–1600 psi, with 1500 psi being preferred.

The low pressure lance 44 preferably has two rows of ten nozzles each. The total flow is at the rate of 40–90 gpm, with 50 gpm being preferred, under a pressure of 75–90 psi, with 80 psi being preferred.

The high pressure pump is a positive displacement pump rated at 40 gpm at a pressure of 1500 psi. The recirulation pump is an electrically driven, direct drive centrifugal pump rated at 225 gpm at a pressure of 140 psi.

Figure 7:
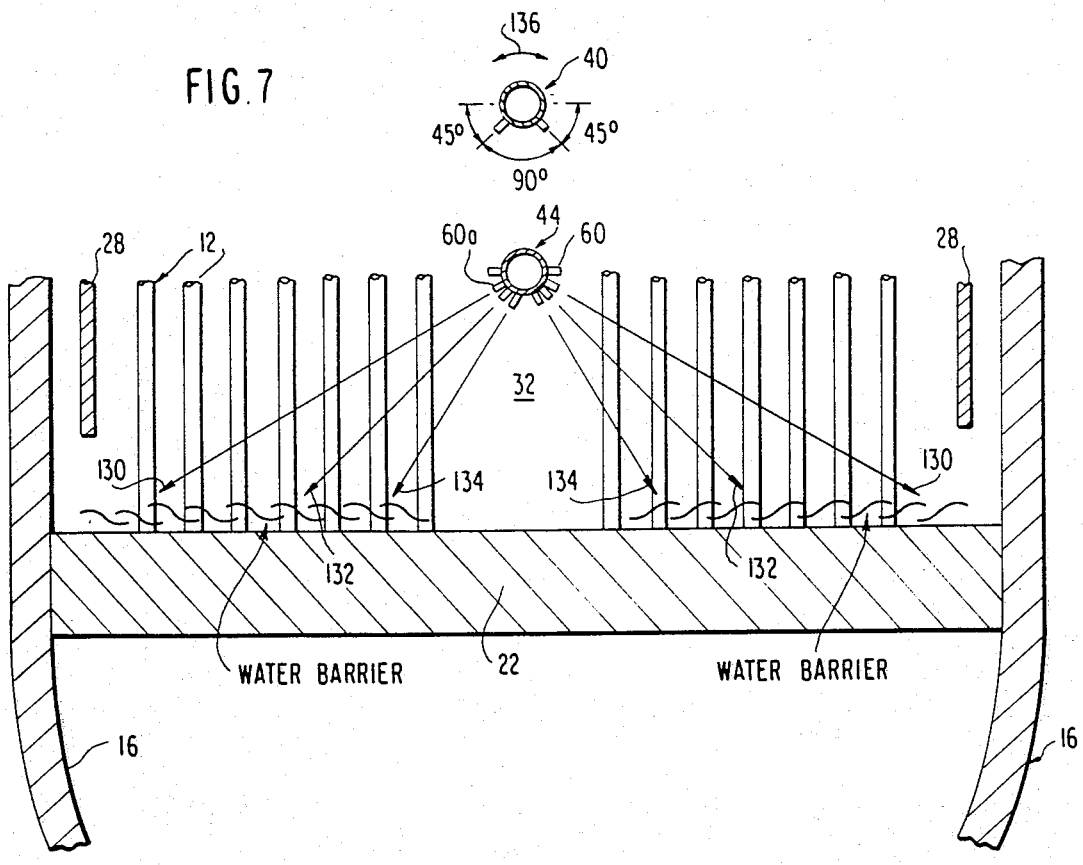
FIG. 7 is a schematic side elevational view of FIG. 1 and shows the orientation of the nozzles of the lances and also the formation of a water barrier for preventing the redeposition of sludge.

FIG. 7 shows that the three pairs of innermost nozzles 60a of the ten nozzles 60 on the low pressure lance 44 are angled at three different angles represented by the arrows 130, 132 and 134 so that their flows are directed to the outermost, intermediate and innermost portions, respectively, of the tube sheet, thereby producing a water barrier that prevents redeposition of sludge on previously cleaned areas of the tube sheet 22. Such an arrangement also removes sludge loosened, but not removed, by the high pressure lance 40. The remaining seven of the pairs of nozzles 60 are oriented in a substantially horizontal direction. FIG. 7 also shows the high pressure lance 40 with its two rows of nozzles 42 being pointed downwardly and separated by an included angle of approximately 90° in the rest position of the lance. The double-headed arrow 136 indicates the previously described back and forth rocking motion of 45° from either side of the vertical to the horizontal.

While a preferred embodiment of the invention has been described in the foregoing specification and illustrated in the attached drawing, it is to be understood that obvious variations of this preferred embodiment will become apparent to those of ordinary skill in the art and that the scope of the invention is limited only by the following claims.

We claim:

1. A method of removing sludge from a steam generator of the type comprising an inner vertically oriented U-shaped bundle of heat transfer tubes having their open ends in fluid communication with holes in a tube sheet extending horizontally across the lower portion of a generally cylindrical outer shell of the generator, a central tube lane being defined between the legs of the U and extending beween two diametrically opposite hand holes in the outer shell, and a peripheral lane being defined between the tube bundle and the outer shell of the generator, said method comprising the steps of:

inserting in a first of said hand holes a first movable fluid lance carrying on the inner end thereof a plurality of first nozzles which emit a plurality of high pressure high volume fluid jets when said lance is activated;

activating said lance and moving it inwardly along said tube lane to dislodge sludge deposited on said tube sheet and around said tubes;

inserting in said first hand hole a second movable fluid lance carrying on the inner end thereof a plurality of second nozzles which emit a plurality of low pressure high volume fluid jets upon activation of said second lance;

activating said second lance while said first lance is activated, after said first lance has moved inwardly a preselected distance, to dislodge sludge, to form a water barrier against redeposition of dislodged sludge and, together with the flow from said first lance, to suspend dislodged sludge particles in a volume of water flowing toward said peripheral lane; and removing, by suction, the fluid-entrained sludge flowing in said peripheral lane.

2. The method as defined in claim 1 further comprising the steps of:

placing a pair of peripherally spaced suction tubes on said tube sheet in said peripheral lane beneath each hand hole; and reducing the velocity of said fluid-entrained sludge flowing in said peripheral lane by placing a suction dam in the space between said suction tubes.

3. The method as defined in claim 1 further comprising providing said plurality of said first nozzles as two axially extending rows of four nozzles each, and providing said plurality of second nozzles as two axially extending rows of ten nozzles each.

4. The method as defined in claim 3 wherein:

fluid is supplied to said first lance under a first pressure in the range of 1000–1600 psi, and wherein fluid is emitted from said first nozzles at a first rate of 30–50 gpm; and fluid is supplied to said second lance under a second pressure in the range of 75–90 psi, and wherein fluid flows from said second nozzles at a second rate in the range of 40–90 gpm.

5. The method as defined in claim 4 wherein said first pressure is 1500 psi, said first rate is 40 gpm, said second pressure is 80 psi, and said second rate is 50 gpm.

6. The method as defined in claim 3 further comprising the step of oscillating said first lance about its longitudinal axis to produce a hydraulic sweeping action from said central tube lane of the generator, through the tube bundle and toward the outer shell.

7. The method as defined in claim 6 further comprising the steps of:

placing said two rows of said first nozzles so that, in a rest position of said first lance, the two rows are pointed downwardly toward the tube sheet and are separated by an angle of approximately 90° centered on the vertical; and oscillating said first lance through an angle of approximately only 45° on both sides of the vertical.

8. The method as defined in claim 7 further comprising the step of placing the innermost three pairs of said second nozzles in said two rows so that said three pairs are directed downward toward said tube sheet and so that the flows from said three pairs are pointed in directions toward the outermost, intermediate and innermost portions, respectively, of the tube sheet, thereby forming said water barrier.

9. An apparatus for removing sludge from a steam generator of the type comprising an inner vertically oriented U-shaped bundle of heat transfer tubes having their open ends in fluid communication with holes in a tube sheet extending horizontally across the lower portion of a generally cylindrical outer shell of the generator, a central tube lane being defined between the legs of the U and extending beween two diametrically opposite hand holes in the outer shell, and a peripheral lane being defined between the tube bundle and the outer shell of the generator, said apparatus comprising:

first movable fluid lance means mounted on said outer shell at one of said hand holes, said lance means carrying on the inner end thereof a plurality of first nozzles for emitting a plurality of high pressure high volume fluid jets when said lance means is activated;

means for activating said lance means and moving it inwardly along said tube lane to dislodge sludge deposits on said tube sheet and around said tubes;

second movable fluid lance means disposed at said hand hole and carrying on the inner end thereof a plurality of second nozzles which emit a plurality of low pressure high volume fluid jets upon activation of said second lance means;

means for activating said second lance means during activation of said first lance means, after said first lance means has moved inwardly a preselected distance, for dislodging sludge, forming a water barrier against redeposition of dislodged sludge and, together with flow from said first lance means, suspending dislodged sludge particles in a volume of water flowing toward said peripheral lane; and suction means for removing the fluid-entrained sludge flowing in said perpheral lane.

10. The apparatus as defined in claim 9:

wherein said suction means comprises a pair of peripherally spaced suction tubes disposed on said tube sheet in said peripheral lane beneath each hand hole; and further comprising suction dam means, disposed in the space between said suction tubes, for reducing the velocity of said fluid-entrained sludge traveling in said peripheral lane.

11. The apparatus as defined in claim 9 wherein:

said plurality of said first nozzles are arranged in two axially extending rows of four nozzles each; and said plurality of second nozzles are arranged in two axially extending rows of ten nozzles each.

12. The apparatus as defined in claim 11 further comprising:

means for supplying fluid to said first lance means under a first pressure in the range of 1000–1600 psi, so that fluid is emitted from said first nozzles at a first rate of 30–50 gpm; and means for supplying fluid to said second lance means under a second pressure in the range of 75–90 psi so that fluid flows from said second nozzles at a second rate in the range of 40–90 gpm.

13. The apparatus as defined in claim 12 wherein said first pressure is 1500 psi, said first rate is 40 gpm, said second pressure is 80 psi, and said second rate is 50 gpm.

14. The apparatus as defined in claim 10 further comprising means for oscillating said first lance means about its longitudinal axis to produce a hydraulic sweeping action from said central tube lane of the generator, through the tube bundle and toward the outer shell.

15. The apparatus as defined in claim 13 wherein:

said two rows of said first nozzles, in a rest position of said first lance means, are pointed downwardly toward said tube sheet and are separated by an angle of approximately 90° centered on the vertical; and said oscillating means oscillates said first lance means through an angle of approximately 45° on both sides of the vertical.

16. The apparatus as defined in claim 15 wherein the innermost three pairs of said second nozzles in said two rows are directed downwardly toward said tube sheet so that the flows from said three pairs are pointed in directions toward the outermost, intermediate and innermost portions, respectively, of said tube sheet, thereby forming said water barrier.

* * * * *